US005282542A

United States Patent [19]

Mo

[11] Patent Number: 5,282,542

[45] Date of Patent: Feb. 1, 1994

[54] LOAD CARRIER

[76] Inventor: Yau-Kee Mo, Flat 02 10th Floor Block A, Lotto Villa, 18 Broadwood Rd., Happy Valley, Hong Kong

[21] Appl. No.: 982,805

[22] Filed: Nov. 30, 1992

[51] Int. Cl.[5] ..... B65D 8/14

[52] U.S. Cl. ..... 220/7; 220/485

[58] Field of Search ..... 220/7, 6, 4.28, 485

[56] References Cited

U.S. PATENT DOCUMENTS

| | | | |
|---|---|---|---|
| 3,889,837 | 6/1985 | Wilson | 220/7 |
| 4,887,874 | 12/1989 | Joffe | 220/7 |
| 4,978,020 | 12/1990 | Aono | 220/7 |
| 5,114,034 | 5/1992 | Miller et al. | 220/7 |

*Primary Examiner*—Joseph Man-Fu Moy

*Attorney, Agent, or Firm*—Panitch Schwarze Jacobs & Nadel

[57] ABSTRACT

A load carrier which is made from a tough and bendable material, includes a bottom member that has a predetermined number of sides and a plurality of side walls that are mounted on the bottom member and cooperatively define a surrounding wall. Each of the side walls has a lower portion wrapped around the respective side of the bottom member in such a manner that the side wall is pivotable relative to the latter. Each of the side walls has a first fastening piece mounted on one side thereof and which abuts a second fastening piece mounted on one side of an adjacent side wall when the side walls are pivoted to a perpendicular position relative to the bottom member. A locking member fastens detachably the adjacent side walls.

2 Claims, 3 Drawing Sheets

LOAD CARRIER

BACKGROUND OF THE INVENTION

1. FIELD OF INVENTION

This invention relates to a load carrier, more particularly to a load carrier which includes a bottom member and a surrounding wall that has a lower portion wrapped around the periphery of the bottom member in such a manner that the surrounding wall is pivotable relative to the bottom member. The surrounding wall is held vertically relative to the bottom member by means of locking members.

2. DESCRIPTION OF THE RELATED ART

A conventional load carrier includes a bottom member and a surrounding wall connected to the periphery of the bottom member so as to confine a load receiving space therein. The load carrier is generally made from metal, rattan stem, bamboo strap or bendable plastic material. In the conventional load carrier, the surrounding wall is integrally formed with the bottom member. Therefore, the load carrier has a predetermined shape and height. Thus, a large space or a large vehicle is needed when storing or when shipping the conventional load carriers to a desired destination. Renting a large storage room or vehicle results in higher costs.

SUMMARY OF THE INVENTION

A main object of the present invention is to provide a load carrier which includes a bottom member and a surrounding wall that has a lower portion wrapped around the periphery of the bottom member in such a manner that the surrounding wall is pivotable relative to the bottom member. The surrounding wall is vertically held relative to the bottom member by means of locking members If desired, the locking members can be unfastened, and the surrounding wall can be made to lie in level with the bottom member to reduce the height of the load carrier and thereby facilitate transport and storage.

According to the present invention, the load carrier is made from a tough and bendable material, such as rattan stem, bamboo strap or plastic, and includes a bottom member with a predetermined number of sides and a surrounding wall which has a plurality of side walls that correspond to the sides of the bottom member. Each of the side walls has a lower portion wrapped around the respective side of the bottom member in such a manner that the side wall is pivotable relative to the respective side of the bottom member. Each of the side walls further has a first fastening piece provided on one side thereof and which abuts a second fastening piece provided on one side of an adjacent side wall when the side walls are pivoted to a perpendicular position with respect to the bottom member. A set of locking members fastens detachably the first and second fastening pieces thereby retaining the side walls at the perpendicular position. In the event that the load carriers are to be stored or transported to a desired destination, the locking members are unfastened so as to permit unfolding of the side walls, thereby achieving a reduction in the space occupied by the load carrier.

BRIEF DESCRIPTION OF THE DRAWINGS

Other features and advantages of the present invention will become more apparent in the following detailed description, including drawings, all of which show a non-limiting form of the present invention, and in which.

DETAILED DESCRIPTION OF THE PREFERRED EMBODIMENT

Figure 1:
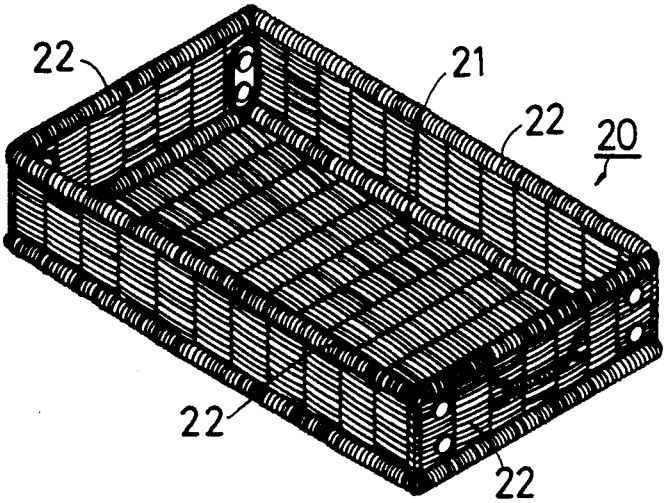
FIG. 1 shows a perspective, schematic view of a load carrier of the present invention.
Figure 2:
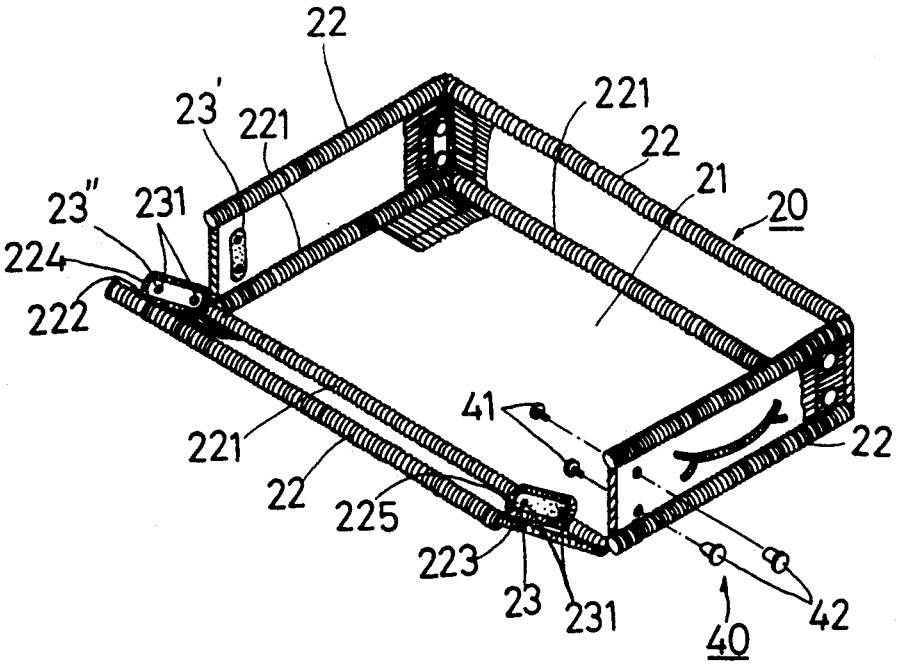
FIG. 2 shows a partially exploded view of the load carrier of FIG. 1.
Figure 3:
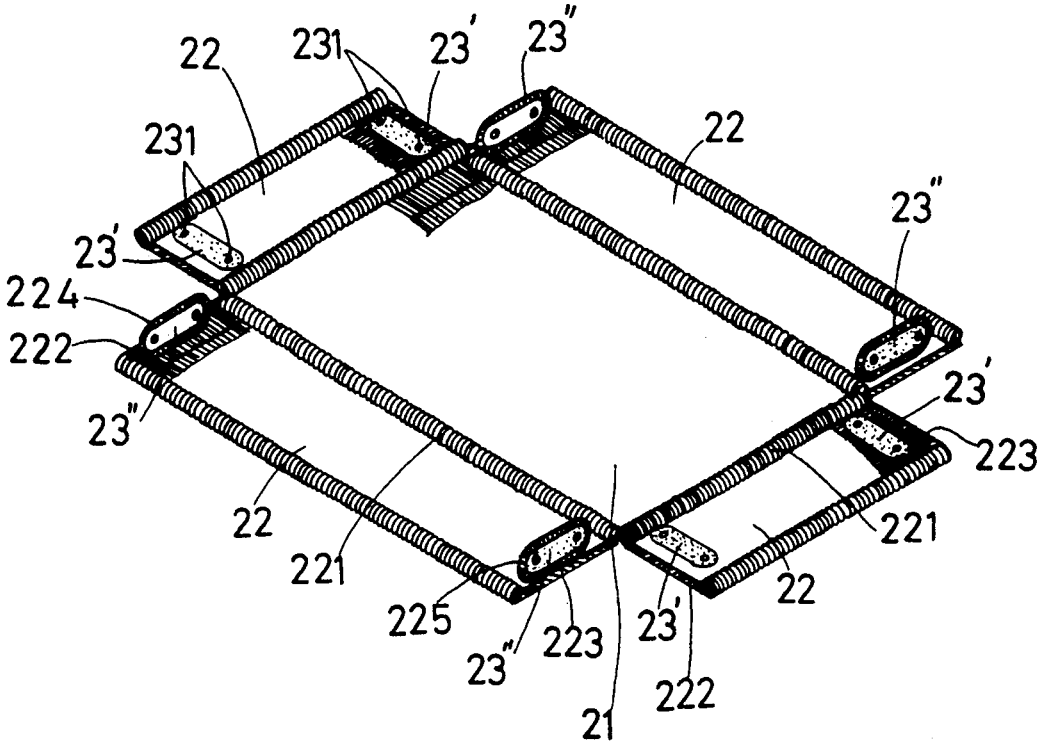
FIG. 3 shows the load carrier of FIG. 1 in an unfolded position.

Referring to FIGS. 1, 2 and 3, a load carrier (20) of the present invention is made from rattan, bamboo or bendable plastic material and includes a bottom member (21) with a predetermined number of sides and a surrounding wall which has a plurality of side walls (22) that correspond to the sides of the bottom member (21).

In the preferred embodiment, the bottom member (21) is rectangular in shape and has four sides. Four side walls (22) cooperatively form the surrounding wall in this embodiment. Each of the side walls (22) has a lower portion (221) wrapped around the respective side of the bottom member (21) in such a manner that the side wall (22) is pivotable relative to the respective side of the bottom member (21). Each of the shorter side walls (22) has a first fastening piece (23') mounted fixedly thereon on one side thereof. Each of the longer side walls has a retaining ear (224, 225) formed integrally and pivotally thereon on one side thereof. The retaining ear (224, 225) extends perpendicularly from the long side wall (22) and encloses securely the periphery of a second fastening piece (23''). A set of hook-and-loop fasteners is used as the first and second fastening pieces (23', 23'') in the preferred embodiment. When the side walls (22) are pivoted to a perpendicular position with respect to the bottom member (21), the first and second fastening pieces (23', 23'') are disposed to overlap with one another. Each of the fastening pieces (23', 23'') has two through-holes (231) extending therethrough. A locking member (40) includes a locking bolt (41) which is inserted through the through-hole (231) and which engages a nut (42) so as to hold together the adjacent shorter and longer side walls (22). The pivotal connection between the retaining ears (224, 225) and the longer side walls (22) permits abutment of the second fastening pieces (23'') with the first fastening pieces (23').

Alternatively, the retaining ears (224, 225) can be mounted pivotally on the shorter side walls (22) on one side thereof so as to hold the first fastening pieces (23') perpendicularly relative to the shorter side walls (22), while the second fastening pieces (23'') can be mounted fixedly on the longer side walls (22) one side thereof.

Figure 5:
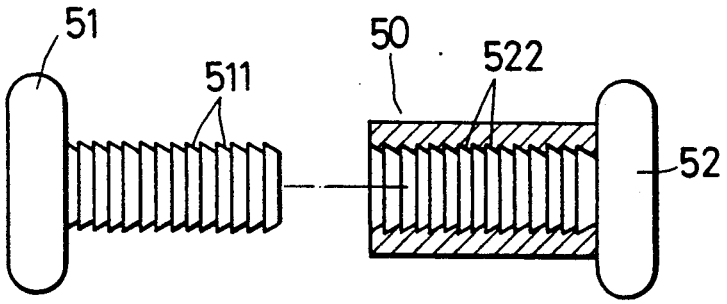
FIG. 5 shows a locking member employed in the load carrier of the present invention.

Referring to FIG. 5, a locking member (50) can be employed in the load carrier of the present invention instead of the locking member (40). The locking member (50) includes a locking bolt (51) with a plurality of barbed projections (511) formed on a shank thereof, and a nut (52) with a plurality of grooves (522) that are adapted to engage the barbed projections (511) when the locking bolt (51) is press-fitted into the nut (52). The locking bolt (51) is pulled outwardly with respect to the nut (52) so as to disengage the two elements.

Figure 4:
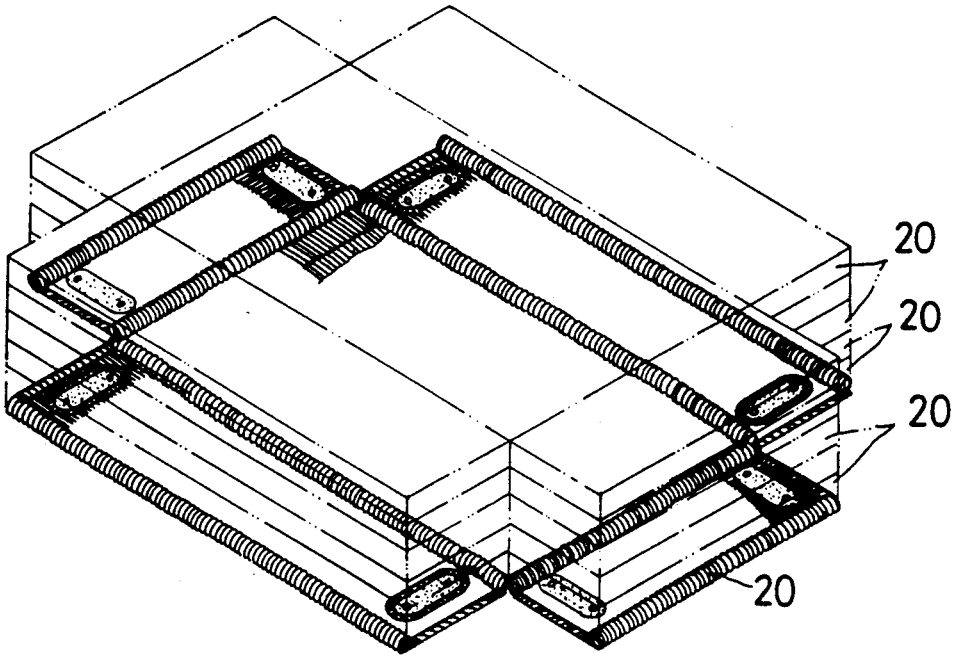
FIG. 4 shows a plurality of the load carriers of the present invention when piled one on top of the other for transport or storage purposes.

In the event that a plurality of load carriers (20) of the present invention are to be stored or shipped to a desired destination, the locking members (40, 50) which join together adjacent side walls (22) are unfastened so as to lie in level with the bottom member (21), as shown in FIG. 3. The side walls (23) can be pivoted inwardly of the bottom member (21) so as to lie on top of the bottom member (21). The load carriers (20) are piled one on top of the other, as shown in FIG. 4. Thus, a large storage space or a large vehicle is not required when transporting and/or storing a plurality of load carriers of the present invention. The object and feature of the present invention are therefore achieved.

While a preferred embodiment has been illustrated and described, it will be apparent that many changes and modifications may be made in the general construction and arrangement of the present invention without departing from the spirit and scope thereof. Therefore, it is desired that the present invention be not limited to the exact disclosure but only to the extent of the appended claims.

I claim:

1. A load carrier including:

a bottom member formed of a tough and bendable material and having a predetermined number of sides;

a surrounding wall formed of a tough and bendable material and having a predetermined number of side walls that corresponds to the number of sides of the bottom member, each of the side walls having an edge pivotably attached to a corresponding side of the bottom member and first and second ends, each of the side walls being pivotable relative to the bottom member from a first position in which the side wall and the bottom member are generally co-planar to a second position in which the side wall is generally perpendicular to the bottom member, the ends of each side wall abutting adjacent ends of adjacent side walls when the side walls are pivoted to the second position;

a predetermined number of fastening pairs corresponding to the number of side walls, each fastening pair comprising a first fastening piece fixedly mounted to a side wall proximate to one end thereof, and a second fastening piece mounted on a retaining ear formed integrally and pivotably on an adjacent side wall proximate to the one end, such that when the side wall having the first fastening piece and the adjacent side wall having the second fastening piece are pivoted to the second position and the retaining ear is pivoted, the first fastening piece and the second fastening piece are in engagement with each other, the first and second fastening pieces comprising sets of hook-and-loop fasteners; and a predetermined number of sets of locking members corresponding to the number of fastening pairs, each set of locking members cooperating with a fastening pair for detachably fastening together the engaged first and second fastening pieces for retaining the side wall and the adjacent side wall perpendicularly with respect to the bottom member and abuttingly with respect to each other.

2. A load carrier including:

a bottom member formed of a tough and bendable material and having a predetermined number of sides;

a surrounding wall formed of a tough and bendable material and having a predetermined number of side walls that corresponds to the number of sides of the bottom member, each of the side walls having an edge pivotably attached to a corresponding side of the bottom member and first and second ends, each of the side walls being pivotable relative to the bottom member from a first position in which the side wall and the bottom member are generally co-planar to a second position in which the side wall is generally perpendicular to the bottom member, the ends of each side wall abutting adjacent ends of adjacent side walls when the side walls are pivoted to the second position;

a predetermined number of fastening pairs corresponding to the number of side walls, each fastening pair comprising a first fastening piece fixedly mounted to a side wall proximate to one end thereof, and a second fastening piece mounted on a retaining ear forming integrally and pivotably on an adjacent side wall proximate to the one end, such that when the side wall having the first fastening piece and the adjacent side wall having the second fastening piece are pivoted to the second position and the retaining ear is pivoted, the first fastening piece and the second fastening piece are in engagement with each other, the first and second fastening pieces each having at least one hole, the holes being in registry when the fastening pieces are engaged with each other; and a predetermined number of sets of locking members corresponding to the number of fastening pairs, each set of locking members cooperating with a fastening pair for detachably fastening together the engaged first and second fastening pieces for retaining the side wall and the adjacent side all perpendicularly with respect to the bottom member and abuttingly with respect to each other, the locking members comprising locking nuts and bolts, the locking nuts and bolts for being connected through the registered holes in the first and second fastening pieces.

* * * * *